US005538123A

United States Patent [19]

Tsuji

[11] Patent Number: 5,538,123

[45] Date of Patent: Jul. 23, 1996

[54] COIN DISCRIMINATING APPARATUS

[75] Inventor: Keiji Tsuji, Inba-gun, Japan

[73] Assignee: Laurel Bank Machines Co:, Ltd., Tokyo, Japan

[21] Appl. No.: 440,919

[22] Filed: May 15, 1995

[30] Foreign Application Priority Data

| | | | |
|---|---|---|---|
| May 19, 1994 | [JP] | Japan | 6-105687 |
| May 19, 1994 | [JP] | Japan | 105688 |
| Apr. 27, 1995 | [JP] | Japan | 7-104286 |

[51] Int. Cl.[6] ..... G07D 5/08; G07D 5/02

[52] U.S. Cl. ..... 194/303; 194/328; 194/334

[58] Field of Search ..... 194/302, 303, 194/317, 318, 319, 328, 330, 334

[56] References Cited

U.S. PATENT DOCUMENTS

| | | | |
|---|---|---|---|
| 4,577,744 | 3/1986 | Doucet | 194/334 X |
| 4,715,223 | 12/1987 | Kaiser et al. | 194/334 X |
| 4,848,556 | 7/1989 | Shah et al. | 194/334 X |
| 5,076,414 | 12/1991 | Kimoto | 194/334 X |

FOREIGN PATENT DOCUMENTS

| | | | |
|---|---|---|---|
| 233591 | 9/1989 | Japan | 194/328 |
| 112090 | 4/1990 | Japan | 194/328 |
| 259982 | 10/1990 | Japan | 194/328 |
| 5046840 | 2/1993 | Japan | 194/328 |
| 628542 | 2/1994 | Japan . | |

*Primary Examiner*—Karen B. Merritt
*Assistant Examiner*—Scott L. Lowe
*Attorney, Agent, or Firm*—Cushman, Darby & Cushman

[57] ABSTRACT

A coin discriminating apparatus includes a light emitter for illuminating the surface of a coin, a light receiver for receiving reflected light from the surface of the coin and producing pattern data of the coin, a pattern data memory for storing the pattern data of the coin produced by the light receiver, a reference data memory for storing reference pattern data of each denomination, a magnetic sensor for detecting a material of the coin, a first discriminator for determining the denomination of the coin based on the material of the coin detected by the sensor, a second discriminator for determining the denomination of the coin based on the diameter of the coin, a denomination discriminator for determining the denomination of the coin based on the determined results by the first and second discriminators, a data comparator for reading reference pattern data corresponding to the denomination of the coin stored in the reference data memory based on the determined result by the denomination discriminator and comparing the pattern data stored in the pattern data memory, thereby determining the denomination of the coin. According to the thus constituted coin discriminating apparatus, it is possible to discriminate coins with high accuracy and at high speed.

10 Claims, 8 Drawing Sheets

COIN DISCRIMINATING APPARATUS

BACKGROUND OF THE INVENTION

The present invention relates to a coin discriminating apparatus and, in particular, to a coin discriminating apparatus for discriminating coins by optically detecting coin surface patterns.

DESCRIPTION OF THE PRIOR ART

In order to determine whether or not coins are acceptable, namely, to determine the genuineness of coins and whether or not the coins are the circulating coins, the conventional apparatus detects the diameter, the material and the thickness of the coins. Recently, in order to improve discriminating accuracy, a coin discriminating apparatus for discriminating coins which optically detects surface pattern of the coins is proposed.

For example, Japanese Patent Application Laid Open No. 6-28542 proposes a coin discriminating apparatus which optically detects the surface pattern of the coins, and compares it with reference patterns, thereby determining the denomination of the coins and whether or not the coins are acceptable.

This coin discriminating apparatus discriminates the coins in the following manner. It emits the light toward the coins at a shallow angle, detects the reflected light from the coins by an image sensor, and binarizes the resulting optical data to produce binary image data. The binary image data obtained in such a manner are divided into binary image area data corresponding to a plurality of annular areas of the coin surface. It then calculates the number of "0" data or "1" data included in the binary image area data corresponding to each annular area of the coin surface, calculates the ratio, Sn of the "0" data or "1" data with respect to the entire data, and obtains surface pattern data of the entire coin surface in accordance with the variation of the value of Sn in a radial direction of the coin. It compares the surface pattern data with reference surface pattern data which are obtained for each denomination in advance, thereby determining the denomination of the coins and whether or not the coin is acceptable.

In general, when the denomination of the coin and whether or not the coin is acceptable are determined by obtaining the surface pattern of the coin and comparing it with the reference surface pattern, the denomination of the coin and whether or not the coin is acceptable cannot be determined by comparing the binary image area data corresponding to each annular area of the coin with a reference binary image area data if the coin is rotated circumferentially with respect to a reference position of the coin. In this case, it is necessary to rotate the obtained binary image area data corresponding to each annular area of the coin so that they can be compared with the reference binary image area data. However, this coin discriminating apparatus obtains the surface pattern data of the entire coin surface in accordance with the variation of the value of Sn in a radial direction of the coin, where Sn is the ratio of the "0" or "1" data included in the binary image area data corresponding to each annular area of the coin surface. Then, it compares the surface pattern data with the reference surface pattern data of the coin of each denomination, thereby determining the denomination of the coin and whether or not the coin is acceptable. Therefore, it has the advantage shortening the calculation time even if the coin is rotated in a circumferential direction with respect to the reference position since it is not necessary to rotate the obtained binary image area data corresponding to each annular area of the coin.

However, even then, such coin discriminating apparatus has a problem that it takes time for determination since it compares the obtained surface pattern data with the reference surface pattern data of all the denominations, in order to determine the denomination of the coin and whether or not the coin is acceptable.

SUMMARY OF THE INVENTION

It is, therefore, an object of the present invention to provide a coin discriminating apparatus which can discriminate the coin with an high accuracy and at high speed.

The above and other objects of the present invention can be accomplished by a coin discriminating apparatus, comprising; illuminating means for emitting light and illuminating a surface of a coin, light receiving means for receiving reflected light from the surface of said coin and producing pattern data of said coin, pattern data storing means for storing the pattern data of said coin produced by said light receiving means, reference data storing means for storing reference pattern data of each denomination, sensor means for detecting a material of the coin, first determining means for determining a denomination of the coin based on the material of the coin detected by said sensor means, second determining means for determining the denomination of the coin based on a diameter of the coin, denomination determining means for determining the denomination of the coin based on the determined results by said first and second determining means, data comparing means for reading the reference pattern data corresponding to the denomination of the coin stored in said reference data storing means based on the determined result by said denomination determining means and comparing them with the pattern data stored in said pattern data storing means, thereby determining the denomination of the coin.

In a preferred aspect of the present invention, said pattern data storing means is adapted to map and store the pattern data of said coin produced by said light receiving means in a x-y coordinate system; and it if further provided with center coordinate determining means for calculating center coordinates of the pattern data mapped in the x-y coordinate system in the pattern data storing means, and pattern data converting means for converting the pattern data mapped in the x-y coordinate system and stored in said pattern data storing means into the r-θ coordinate system based on center coordinates in the x-y coordinate system of the pattern data calculated by said center coordinate determining means, thereby producing converted pattern data; and said reference data storing means is adapted to store the reference pattern data mapped in the r-θ coordinate system and said data comparing means is adapted to correct said converted pattern data along the θ-axis and compares corrected converted pattern data with the reference pattern data corresponding to the denomination read from said reference data storing means based on the determined result by said denomination determining means, thereby determining the coin.

In a further preferred aspect of the present invention, said each reference pattern data includes the reference pattern data of both faces of the coin.

In a still further preferred aspect of the present invention, it is further comprised with light emitting control means for controlling said light emitting means, and said light emitting control means is adapted to control the amount of light emitted from said illuminating means based on the determined result by said first determining means.

In a still further preferred aspect of the present invention, it is further comprised with light receiving control means for controlling said light receiving means, and said light receiving control means is adapted to control the length of time for which said light receiving means receives the light based on the determined result by said first determining means.

The above and other objects and features of the present invention will become apparent from the following description made with reference to the accompanying drawings.

DESCRIPTION OF THE PREFERRED EMBODIMENTS

Figure 1:
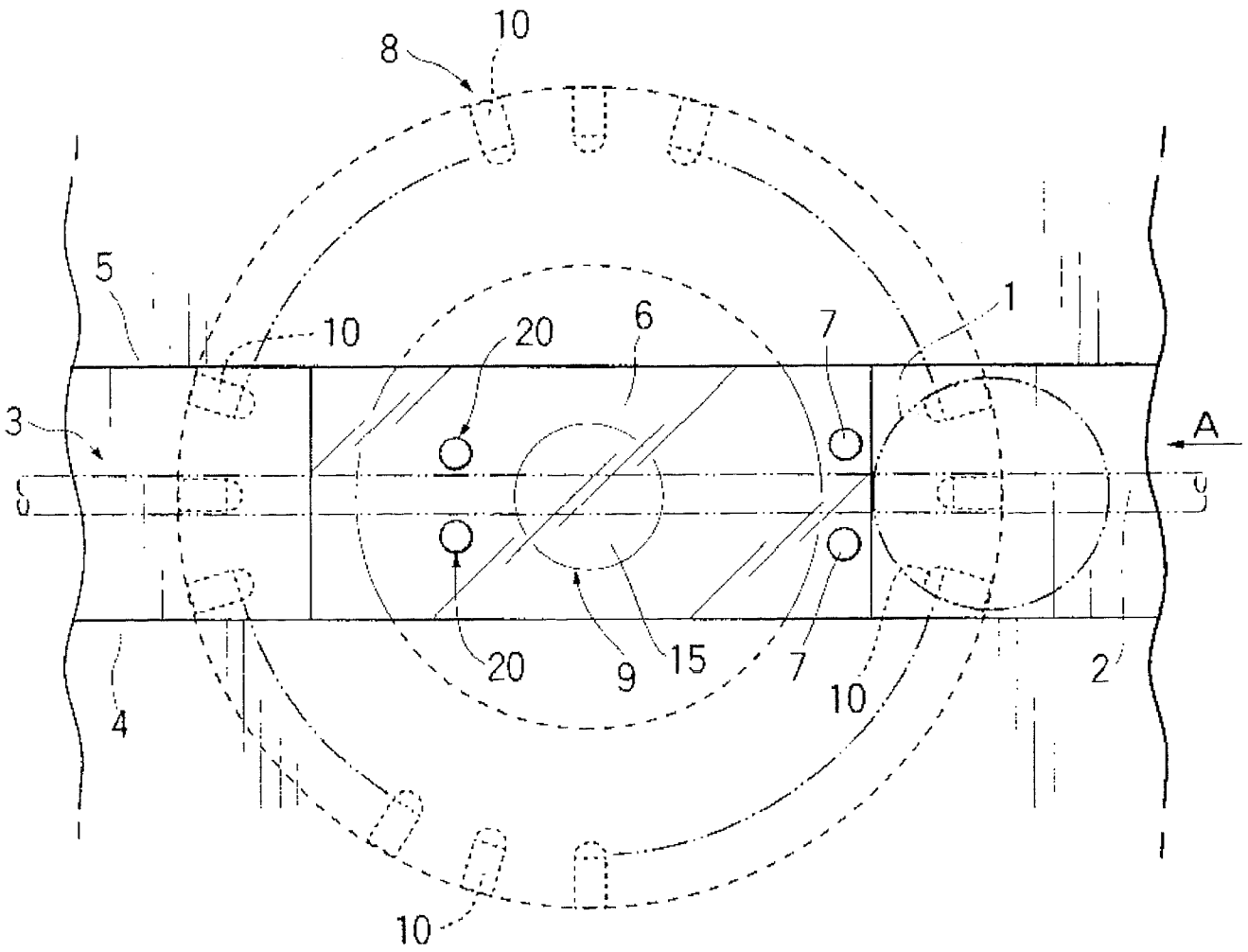
FIG. 1 is a schematic plan view of a coin discriminating portion of a coin discriminating apparatus which is an embodiment of the present invention.
Figure 2:
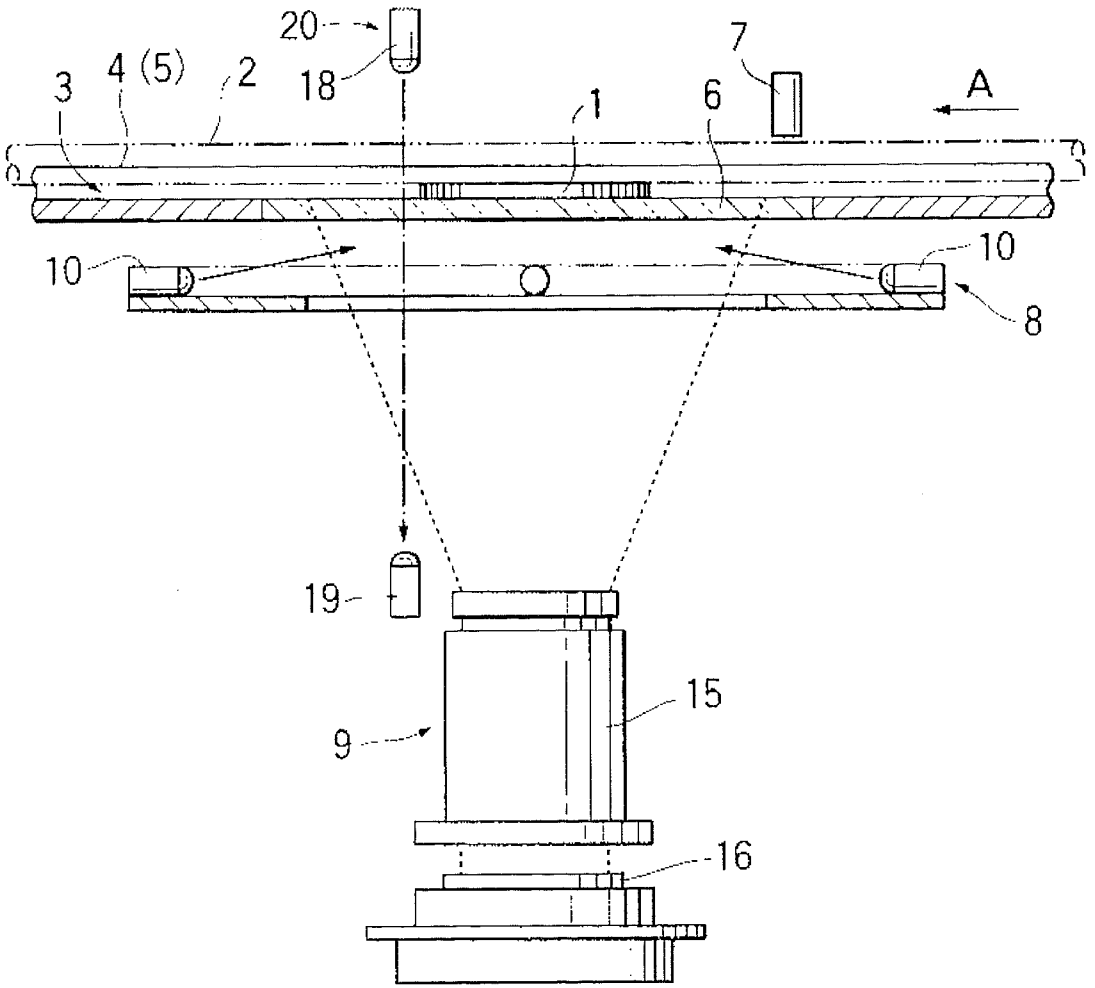
FIG. 2 is a schematic side view of a coin discriminating portion of a coin discriminating apparatus which is an embodiment of the present invention shown in FIG. 1.

As shown in FIGS. 1 and 2, a coin 1 is pressed onto the surface of a coin passage 3 by an endless belt 2 while it is being transported through the coin passage 3 along a pair of guide rails 4, 5 in the direction indicated by an arrow A. The coin passage 3 is provided with a transparent passage portion 6 made of a light transmissible transparent material such as glass, acrylic resin or the like. On the upstream side of the transparent passage portion with respect to the coin transportation direction, a pair of magnetic sensors 7, 7 for detecting a magnetic property of the coin 1 is provided. A light emitting means 8 for illuminating the coin 1 which passes the transparent passage portion 6 is provided below the transparent passage portion 6. An image data producing means 9 for receiving the light that is emitted from the light emitting means 8 and reflected from the coin 1 and producing image data is provided further below the light emitting means 8.

As shown in FIG. 1, the light emitting means 8 is comprised of many light emitting elements 10 such as LED or the like disposed along a circle about an axis passing the center of the transparent passage portion 6. Each light emitting element 10 is disposed such that its optical axis forms a small angle with respect to the horizontal direction and directs toward a predetermined location on a center axis of a circle whose center is located at the center of the transparent passage portion 6, whereby it can illuminate the coin 1 which passes through the transparent passage portion 6 at a shallow angle.

The image data producing means 9 includes a lens system 15 which is disposed such that its optical axis coincides with the center axis of the circle whose center is located at the center of the transparent passage portion 6. It further includes a CCD 16 which is disposed below the lens system 15 and whose focal point is disposed so as to locate on the upper face of the transparent passage portion 6. The CCD 16 photoelectrically detects the light emitted from the light emitting element 10 and reflected from the surface of the coin 1. The image data producing means 9 also includes an A/D converter (not shown) which converts image data of the coin 1 photoelectrically detected by the CCD 16 into a digital signal, thereby producing digitized image data.

Two sets of timing sensors 20, 20, each including a light emitting element 18 and a light receiving element 19 are provided on the downstream side of the image data producing means 9 located right next to it. Each of the timing sensors 20, 20 is constituted so that the light emitted from the light emitting element 18 can be received by the light receiving element 19 through the transparent passage portion 6 and it outputs a timing signal when the light receiving element 19 does not receive the light emitted from the light emitting element 18. The timing sensors 20 are disposed with respect to the image data producing means 9 such that the center of the coin 1 is positioned so as to coincide with the center of the transparent passage portion 6 when the light is not received by the light receiving element 19 because the light emitted from the light emitting element 18 is blocked off by the coin 1 advancing on the surface of the transparent passage portion 6 and the timing signals are output.

Figure 3:
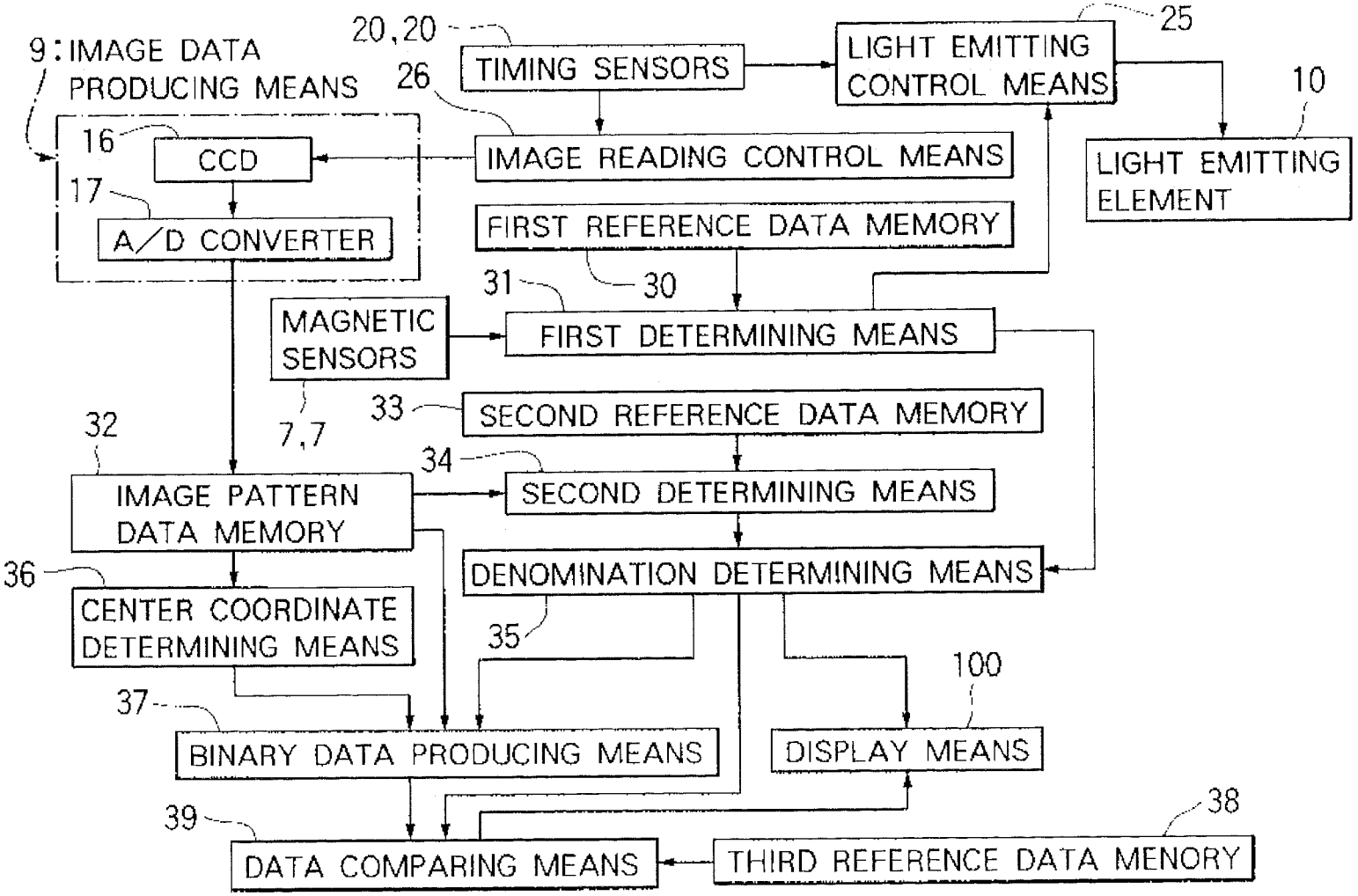
FIG. 3 is a block diagram of detection, control, and discrimination systems of a coin discriminating apparatus which is an embodiment of the present invention.

FIG. 3 is a block diagram of detection, control, and discrimination systems of a coin discriminating apparatus which is an embodiment of the present invention.

As shown in FIG. 3, the detection system of the coin discriminating apparatus is comprised of the two pairs of timing sensors 20, 20 which detect that the coin 1 has reached the transparent passage portion 6.

In FIG. 3, the control system of the coin discriminating apparatus is comprised of light emitting control means 25 which outputs a light emitting signal to the light emitting means 8 when the timing signal from the timing sensors 20 is received and causes it to emit light and illuminates the coin i located on the upper surface of the transparent passage portion 6, and image reading control means 26 for permitting the CCD 16 of the image data producing means 9 to start detecting the light reflected from the surface of the coin 1 when the timing signal from the timing sensors 20 is received.

In FIG. 3, the discriminating system of the coin discriminating apparatus includes first determining means 31 which accesses to a first reference data memory 30 in accordance with detecting signal from the magnetic sensors 7, 7 and compares the magnetic data which indicate the magnetic properties of each denomination stored in the first reference data memory 30 with the magnetic data of the coin 1 input by the detecting signals from the magnetic sensors 7, 7, thereby determining the denomination of the coin 1 detected by the magnetic sensors 7, 7; an image pattern data memory 32 for mapping and storing the image pattern data of the coin 1 that are photoelectrically detected by the CCD 16 and digitized by A/D converter 17 into the rectangular coordinate system, i.e., the x-y coordinate system; second determining means 34 which accesses to a second reference data memory 33 and compares the data relating to the diameter of the coin of each denomination stored in the second reference data memory 33 with the image pattern data of the coin 1 read from the image pattern data memory 32, thereby determining the denomination of the coin 1 based on the diameter of the coin 1; denomination determining means 35 for determining the denomination of the coin 1 based on a first determining signal input from the first determining means 31 and a second determining signal input from the second determining means 34; center coordinate determining means 36 for obtaining the center coordinates of the image pattern data of the coin 1 mapped and stored in the image pattern data memory 32; binary data producing means 37 which binarizes the image pattern data of the coin 1 mapped and stored in the image pattern data memory 32 and groups the binarized image pattern data into binary image pattern data groups corresponding to a plurality of annular areas of the surface of the coin 1 determined for each denomination based on a denomination determining signal input from the denomination determining means 35 and a center coordinate signal input from the center coordinate determining means 36, obtains the number of "0" data in the binary image pattern data groups corresponding to each annular area, obtains the ratio of the "0" data in the entire data, thereby producing ratio data for each binary image pattern data group corresponding to each annular area of the surface of the coin 1; and data comparing means 39 which accesses to a third reference data memory 38 for storing reference ratio data that indicate the ratio of the "0" data in the binary image pattern data groups corresponding to the plurality of the annular areas of the coin surface of each denomination, reads the ratio data in the binary image pattern data groups corresponding to each annular area of the coin surface of the corresponding denomination according to the denomination determining signal input from the denomination determining means 35, compares the ratio data read from the third reference data memory 38 with the ratio data of each binary image pattern data group corresponding to each annular area of the surface of the coin 1 input from the binary data producing means 37, thereby determining the denomination of the coin 1 and whether or not the coin 1 is acceptable. In this embodiment, the first determining signal from the first determining means 31 is output to the light emitting control means 25, and the light emitting control means 25 controls the amount of the emitted light from the light emitting element 10 based on the denomination of the coin 1 determined by the first determining means 31 in accordance with the first determining signal from the first determining means 31. In the third reference data memory 38, the reference ratio data of the binary image pattern data groups corresponding to each annular area of the obverse and reverse faces of all denominations to be processed are stored.

In FIG. 3, the reference number 100 designates display means for displaying whether or not the coin 1 is acceptable.

The thus constituted coin discriminating apparatus which is a preferred embodiment of the present invention determines the denomination of the coin 1 and whether or not the coin 1 is acceptable as follows.

The coin 1 is pressed onto the surface of the coin passage 3 by the endless belt 2 while it is being transported through the coin passage 3 along the pair of guide rails 4, 5 in the direction indicated by the arrow A. The magnetic properties of the coin 1 are detected by the pair of magnetic sensors 7, 7 and the detecting signals are output to the first determining means 31.

The first determining means 31 accesses to the first reference data memory 30 when the detecting signals are input from the magnetic sensors 7, 7, reads the magnetic data which indicate the magnetic properties of each denomination stored in the first reference data memory 30, determines the denomination of the coin 1 by comparing the magnetic data read from the first reference data memory 30 with the magnetic data of the coin 1 input from the magnetic sensors 7, 7 and outputs the first determining signal to the denomination determining means 35 and the light emitting control means 25.

When the coin 1 is fed into the transparent passage portion 6 through the coin passage 3 and blocks off the light emitted from the light emitting element 18 of the timing sensors 20, and the light receiving elements 19 do not receive the light from the light emitting elements 18, the timing signals from the timing sensors 20 are output to the light emitting control means 25 and the image reading control means 26.

When the timing signals are input from the timing sensors 20, the light emitting control means 25 outputs the light emitting signal to the light emitting means 8 based on the first determining signal input from the first determining means 31 and causes it to emit the amount of light that corresponds to the denomination of the coin 1 determined by the first determining means 31 toward the lower surface of the coin 1 located on the transparent passage portion 6. The reason why the amount of emitted light from the light emitting element 10 is controlled based on the determining result of the denomination of the coin 1 by the first determining means 31 is because the amount of reflected light changes depending on the material of the coin 1. If the same amount of light is emitted to the coin 1, the image pattern of the coin 1 cannot be accurately detected. That is, when the coin is made of a material having high light reflectivity such as nickel, aluminum or the like, it becomes difficult to accurately produce the binary data corresponding to the pattern of the surface of the coin 1 by detecting the reflected light from the surface of the coin 1. That is because the total amount of detected light becomes large and saturated if a large amount of light is illuminated. On the other hand, when the coin is made of a material having low light reflectivity such as copper, brass or the like, the binary data corresponding to the pattern on the surface of the coin 1 cannot be accurately produced by detecting the reflected light from the surface of the coin 1. That is because the total amount of detected light is too little if a small amount of light is illuminated. Thus, the light emitting control means 25 is constituted such that when the coin 1 of the denomination determined by the first determining means 31 is made of a material having high light reflectivity such as nickel, aluminum or the like, the light emitting control means 25 outputs the light emitting signal to the light emitting means 8 so that low intensity of light is emitted. On the other hand, it is constituted such that when the coin 1 of the denomination determined by the first determining means 31 is made of a material having low light reflectivity such as copper, brass or the like, the light emitting control means 25 outputs the light emitting signal to the light emitting means 8 so that the light emitting element 10 emits high intensity of light.

The image reading control means 26 causes the CCD 16 of the light data producing means 9 to start detecting the light emitted from the light emitting element 10 and reflected on the lower surface of the coin i when the timing signals from the timing sensors 20 are input.

Since the light emitting means 8 is disposed so as to be able to illuminate the coin 1 which advances on the transparent passage portion 6 at a shallow angle, the light is reflected according to the raised and depressed pattern of the lower surface of the coin 1. The light reflected from the surface of the coin 1 is directed toward the CCD 16 by the lens system 15 and photoelectrically detected by the CCD 16, whereby the image pattern data of the surface of the coin 1 are produced by the CCD 16. The image pattern data of the surface of the coin 1 produced by the CCD 16 are digitized by the A/D converter 17. The digitized image pattern data are mapped and stored in the rectangular coordinate system, i.e. the x-y coordinate system in the image pattern data memory 32.

When the image pattern data of the coin 1 are stored in the image pattern data memory 32, the second determining means 34 accesses to the second reference data memory 33. It reads the data with regard to the diameter of the coin 1 and also the image pattern data stored in the image pattern data memory 32. By comparing those data, the second determining means 34 determines the denomination of the coin 1 and outputs the second determining signal to the denomination determining means 35. There are some coins whose diameters are only slightly different from each other even though their denominations are different. When coins having a slightly larger diameter are worn out, their diameters can happen to coincide. Therefore, in some cases, the denomination of the coin 1 cannot be detected accurately by detecting its diameter. In this embodiment, the first determining means 31 determines the denomination of the coin 1 based on the magnetic properties of the coin 1 and outputs the first determining signal to the denomination determining means 35. The second determining means 34 determines the denomination of the coin 1 based on the diameter of the coin 1 and outputs the second determining signal to the denomination determining means 35. When the denominations of the coin 1 determined by the first and second determining means 31 and 34 based on the first and second determining signals do not coincide, it is constituted to determine that the coin cannot be accepted. Therefore, when the second determining means 34 determines only one kind of denomination of the coin 1 based on the diameter of the coin 1, produces the second determining signal and outputs the second determining signal to the denomination determining means 35, there is a possibility that the denomination determining means 35 determines that the coin 1 is not acceptable even though the coin 1 is an acceptable coin. Accordingly, in this embodiment, the second determining means 34 selects two denominations whose diameters are the closest and the second closest to the diameter of the detected coin 1 and outputs the second determining signals to the denomination determining means 35.

The denomination determining means 35 determines the denomination of the coin 1 based on the first determining signal input from the first determining means 31 and the second determining signal input from the second determining means 34. When the determined results of the first determining means 31 and the second determining means 34 coincide, the denomination determining means 35 outputs the denomination signal to the binary data producing means 37 and the data comparing means 39. When they do not coincide, the coin 1 is a counterfeit coin or a foreign coin and therefore, it determines that it is not acceptable and an unacceptable signal is output to the display means 100 causing it to display that the coin 1 is not acceptable.

The center coordinate determining means 36 determines the center coordinates of the image pattern data mapped and stored in the rectangular coordinate system, i.e. the x-y coordinate system and stored in the image pattern data memory 32 and outputs the center coordinates to the binary data producing means 37. The binary data producing means 37 reads the image pattern data of the Coin 1 mapped and stored in the image pattern data memory 32 and binarizes them. The binary data producing means 37 groups the binarized image pattern data into the binary image pattern data groups of the denomination corresponding to the plurality of annular areas of the surface of the coin 1 and obtains the number of the "0" data in each binary image pattern data group corresponding to each annular area, obtains the ratio of the "0" data with respect to all the data, produces the ratio data of each binary image pattern data group corresponding to each annular area of the surface of the coin 1 and outputs the ratio data to the data comparing means 39.

When the data comparing means 39 receives the denomination signal from the denomination determining means 35, it accesses to the third reference data memory 38, at first, reads the reference ratio data of the reverse face of the coin of the corresponding denomination from the reference ratio data stored in the third reference data memory 38 in accordance with the denomination signal input from the denomination determining means 35, compares the reference ratio data with the ratio data input from the binary data producing means 37, thereby determining the denomination of the coin 1.

When the denomination of the coin 1 is discriminated, the data comparing means 39 calculates the absolute values Di (i=1~n, n is the number of annular areas of the coin 1 which are predetermined for each denomination) of the difference between the reference ratio data of each binary image pattern data group corresponding to each annular area of the coin 1 and the detected ratio data input from the binary data producing means 37. The data comparing means 39 then determines whether or not the absolute values Di of the differences between the reference ratio data of each binary image pattern data group corresponding to each annular area of the coin 1 and the detected ratio data are less than a predetermined value $D_0$. As a result, when the absolute values Di of the differences between the reference ratio data of the binary image pattern data groups corresponding to all annular areas of the coin 1 and the detected ratio data are less than a predetermined value $D_0$, the data comparing means 39 further integrates the absolute values Di of the differences between the reference ratio data and the ratio data over all of the binary image pattern data groups corresponding to the annular area of the coin 1, and determines whether or not the resulted integrated value I is less than the predetermined value $I_0$. As a result, when the integrated value I is less than the predetermined value $I_0$, the data comparing means 39 determines that the coin 1 is the coin of the denomination determined by the denomination determining means 35. Now, it should be noted that if the denomination of the coin 1 coincides with the denomination determined by the denomination determining means 35, theoretically, the absolute value Di and the integrated value I become 0. However, because the surface of the coin 1 may be worn out or a detecting error may exist, they may not be equal to 0 even if the determined denominations coincide. Therefore, in this embodiment, when Di is less than $D_0$ and, at the same time, I is less than $I_0$, it is determined that the coin 1 is the coin of the denomination determined by the denomination determining means 35.

When at least one of the absolute values Di of the differences between the reference ratio data of the binary image pattern data group corresponding to at least one of annular areas of the coin 1 and the detected ratio data are not less than the predetermined value $D_0$, or when the absolute values Di of the differences between the reference ratio data of all the binary image pattern data groups corresponding to each annular region of the coin 1 are less than the predetermined value $D_0$ and at the same time, the integrated value I is not less than the predetermined value $I_0$, the data comparing means 39 cannot determine that the denomination of the coin 1 is same as the denomination determined by the denomination determining means 35. However, the coin 1 cannot be always fed such that its obverse face faces upward and there are cases where the obverse face of the coin 1 faces downward while it is advanced in the coin passage 3. Therefore, to determine that the coin 1 is not acceptable when the detected ratio data of the coin 1 do not coincide with the reference ratio data of the reverse face of the coin of the denomination determined by the denomination determining means 35 will significantly lower discriminating accuracy.

Thus, the data comparing means 39 further accesses to the third reference data memory 38, reads the reference ratio data of the obverse face of the coin of the denomination determined by the denomination determining means 35, and, in exactly the same manner as described above, it determines whether or not the absolute values Di of the differences between the reference ratio data of each binary image pattern data group corresponding to each annular area of the coin 1 and detected ratio data are less than the predetermined value $D_0$. When the absolute values Di of the differences between the reference ratio data of all the binary image pattern data groups corresponding to each annular area of the coin 1 and the detected ratio data are less than the predetermined value $D_0$, the data comparing means 39 integrates the absolute values Di of the differences between the reference ratio data and the ratio data for all the binary image pattern data groups corresponding to each annular area of the coin 1, and determines whether or not the resulted integrated value I is less than the predetermined value $I_0$. As a result, when the integrated value I is less than the predetermined value $I_0$, the data comparing means 39 determines that the coin 1 is the coin of the denomination determined by the denomination determining means 35.

On the other hand, when at least one of the absolute values Di of the differences between the reference ratio data of the binary image pattern data groups corresponding to each annular areas of the obverse face of the coin 1 and the detected ratio data are not less than the predetermined value $D_0$, or when the absolute values Di of the differences between the reference ratio data of the binary image pattern data groups corresponding to each annular region of the obverse face of the coin 1 and the detected ratio data are less than the predetermined value $D_0$ and at the same time, the integrated value I is not less than the predetermined value $I_0$, it means that, as a result of comparing the reference ratio data of the coin of the denomination whose magnetic properties and its diameter are the closest among the denominations with the detected reference data, the surface patterns of the obverse face and the reverse face of the coin 1 are different from the surface patterns of the coin of the denomination determined by the denomination determining means 35. Therefore, since the coin 1 is either a counterfeit coin or a foreign coin and it is determined that that it is not acceptable. The data comparing means 39 outputs the unacceptable signal to the display means 100 and causes to display that the coin 1 is not acceptable.

In accordance with this embodiment, the first determining means 31 determines the denomination of the coin 1 based on the magnetic properties of the coin 1 detected by the magnetic sensors 7, 7 and the second determining means 34 determines the denomination of the coin 1 based on the diameter of the coin 1. The denomination determining means 35 determines the denomination of the coin 1 based on both of the determined results, the data comparing means 39 compares the pattern data of the coin 1 only with the reference data of the denomination determined by the denomination determining means 35, thereby determining the denomination of the coin 1 and whether or not the coin 1 is acceptable. Therefore, the time consumed for determination can be less compared with the case where it is compared with the reference data of all the denominations. When the light reflectivity of the material constituting the coin 1 is low, it is controlled such that the amount of light from the light emitting element 10 which illuminates the coin 1 is increased, and when the light reflectivity of the material constituting the coin 1 is high, it is controlled such that the amount of light from the light emitting element 10 which illuminates the coin 1 is decreased. As a result, irrespective of the material, whether or not the coin 1 is made of a material having a high or low light reflectivity, it is always possible to produce the binary data in accordance with the surface pattern of the coin 1 and accurately determine the denomination of the coin 1 and whether or not the coin 1 is acceptable. Moreover, by comparing the resulted data by calculating the ratio of the "0" data in each pattern data group corresponding to each annular area of the coin 1 with the reference ratio data obtained in advance, the denomination of the coin 1 and whether or not the coin 1 is acceptable are determined. Therefore, without rotating the resulted pattern data of the coin 1 in order to compare with the reference pattern data, it is possible to determine the denomination of the coin 1 and whether or not the coin 1 is acceptable in a shorter time.

Figure 4:
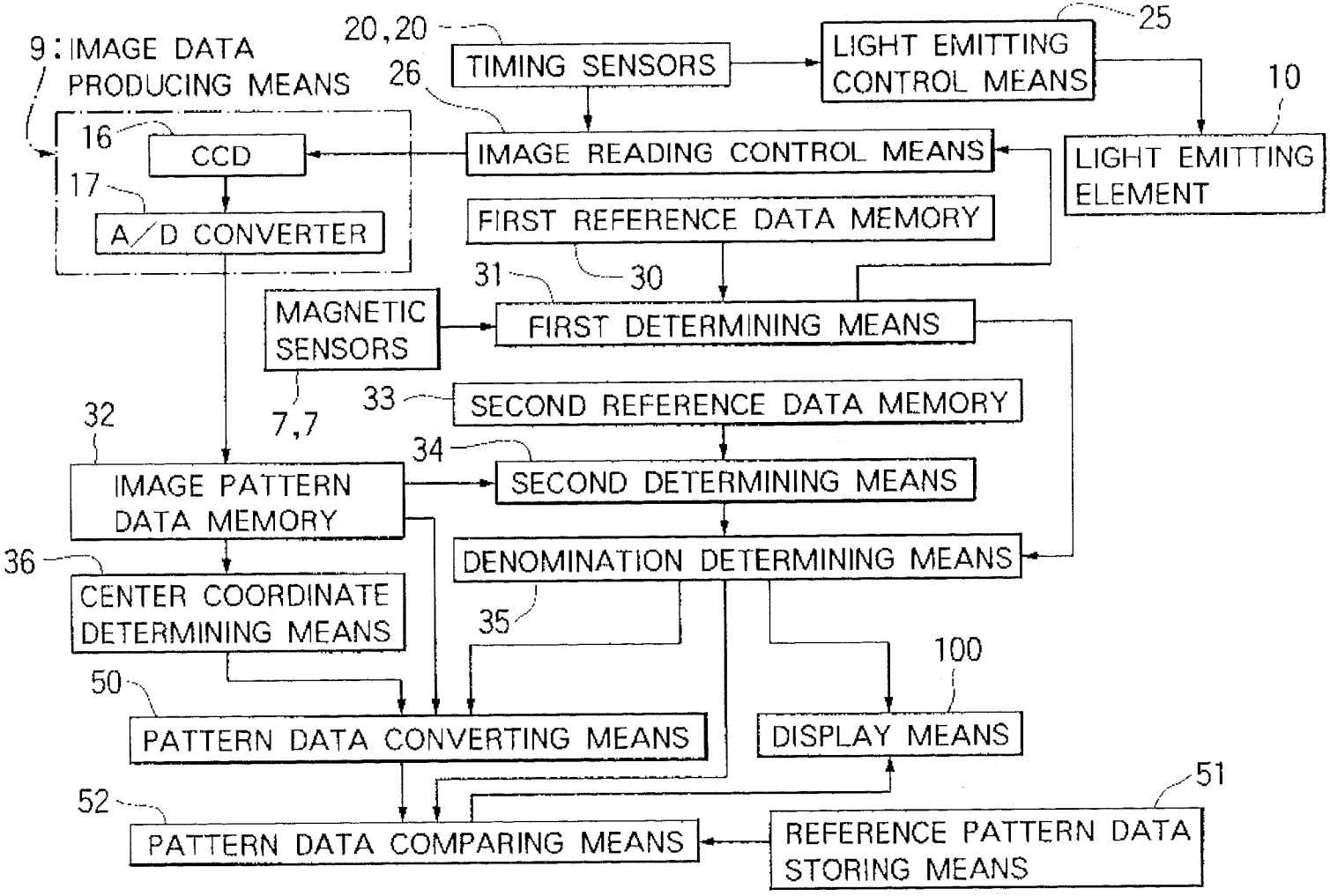
FIG. 4 is a block diagram of the detection, control, discrimination systems of a coin discriminating apparatus which is another embodiment of the present invention.

FIG. 4 is a block diagram of the detection, control, discrimination systems of the coin discriminating apparatus which is another embodiment of the present invention.

In FIG. 4, the detection system of the coin discriminating apparatus comprises the timing sensor 20 and the image data producing means 9 as in the preferred embodiment described above.

In FIG. 4, the control system of the coin discriminating apparatus comprises the light emitting control means 25 and the image reading control means 26 as in the embodiment as described above. Being different from the embodiment as described above, in this embodiment, the first determining signal from the first determining means 31 is not input to the light emitting control means 25 and is input to the image reading control means 26.

In FIG. 4, the discrimination system of the coin discriminating apparatus is comprised of the first reference data memory 30 for storing the reference magnetic data of the coins of each denomination, the first determining means 31 for determining the denomination of the coin 1 based on the magnetic properties of the coin 1 and outputting the first determining signal; the image pattern data memory 32 for mapping and storing the pattern data of the coin 1 produced by the CCD 16 and digitized by the A/D converter 17 in the rectangular coordinate system, i.e., the x-y coordinate system; the second reference data memory 33 for storing the reference data with regard to the diameter of the coins of each denomination; the second determining means 34 for determining the denomination of the coin 1 based on the diameter of the coin 1 and outputting the second determining signal; the denomination determining means 35 for determining the denomination of the coin 1 based on the first determining signal input from the first determining means 31 and the second determining signal input from the second determining means; the center coordinate determining means 36 for calculating the center coordinates of the image pattern data of the coin 1 mapped and stored in the image pattern data memory 32; a pattern data converting means 50 for converting a pattern data by transforming into the polar coordinate system, i.e., the r-θ coordinate system based on the center coordinates of the pattern data calculated by the center coordinate determining means 36; a reference pattern data storing means 51 for storing a reference pattern data for each denomination of the coin 1; a pattern data comparing means 52 for determining the denomination of the coin 1, its genuineness and a foreign coin or not by comparing the converted pattern data transformed into the r-θ coordinate system by the patten data converting means 50 with the reference pattern data stored in the reference pattern data storing means 51.

The reference pattern data storing means 51 is constituted such that it maps and stores the pattern data of both sides of the coin 1 for each denomination into the r-θ coordinate system and outputs the reference pattern data of the coin 1 of the corresponding denomination to the pattern data comparing means 52 in accordance with the denomination determining signal output from the denomination determining means 35.

Figure 5:
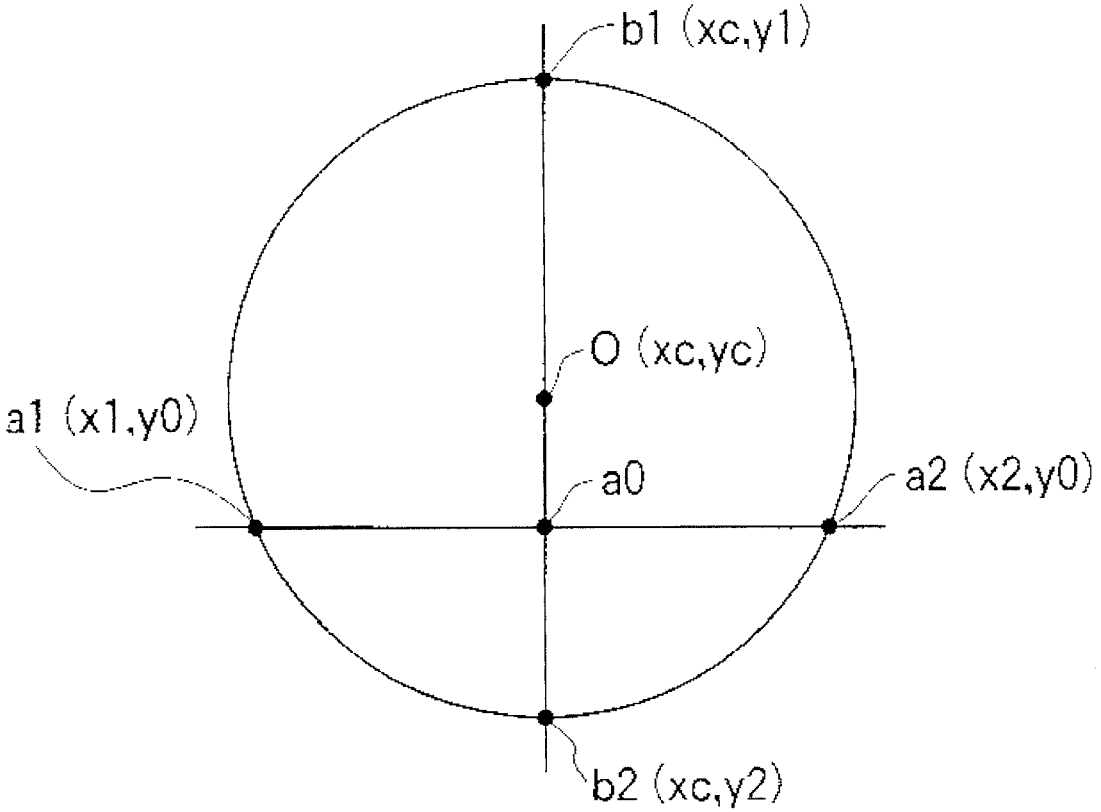
FIG. 5 is a schematic view showing a method for calculating a center coordinates of pattern data effected by a center coordinate determining means 36.

FIG. 5 is a schematic view showing a method for calculating the center coordinates of the pattern data effected by the center coordinate determining means 36.

As shown in FIG. 5, the pattern data of the coin 1 produced by the CCD 16 are mapped in the x-y coordinate system and stored in the image pattern data memory 32. The center coordinate determining means 36 determines x-coordinates x1 and x2 of boundary data a1 and a2 whose y-coordinate is y0 of the pattern data mapped and stored in the mapped pattern data memory 32 and determines an x-coordinate xc=(x1+x2)/2 of a center data a0 between the boundary data a1 and a2. Then, the center coordinate determining means 36 draws an imaginary straight line from the data a0 perpendicular to a straight line extending through the boundary data a1 and a2 to determine y-coordinates y1 and y2 of boundary data b1 and b2 which correspond to the points of intersection of the imaginary straight line and the boundary of the pattern data and determines a y-coordinate yc=(y1+y2)/2 of center data O between the boundary data b1 and b2. The thus determined coordinates (xc, yc) of the data O corresponds to the center coordinates of the pattern data of the coin 1 mapped in the x-y coordinate system and the data O corresponds to the data center of the pattern data of the coin 1 mapped in the x-y coordinate system.

Figure 6:
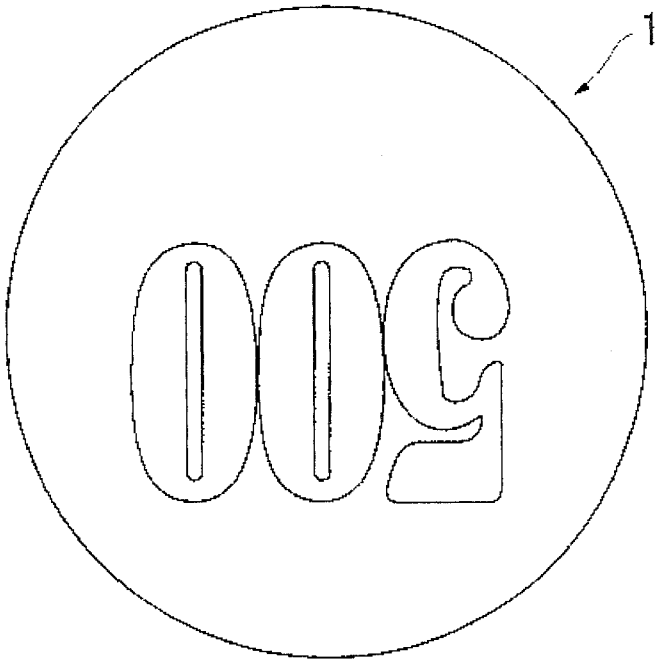
FIG. 6 is an example of pattern data of a coin 1 produced by a CCD 16 and mapped and stored in a mapped pattern data memory 32.
Figure 7:
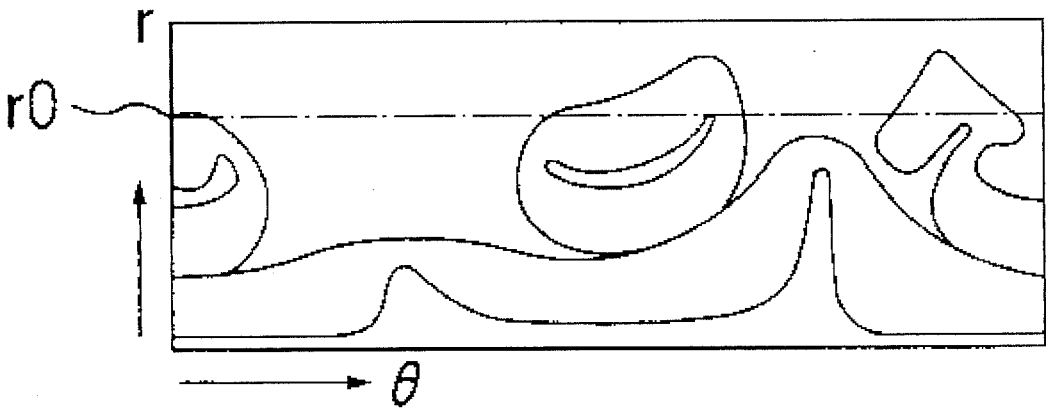
FIG. 7 is converted pattern data produced in a pattern data converting means 50 by transforming the pattern data shown in FIG. 6.

FIG. 6 shows an example of pattern data of a coin 1 produced by the CCD 16 and mapped and stored in the mapped pattern data memory 32 and FIG. 7 shows converted pattern data produced in the pattern data converting means 50 by transforming the pattern data shown in FIG. 6 into an r-θ coordinate system based on the center coordinates (xc, yc) of the pattern data of the coin 1 calculated by the center coordinate determining means 36. In FIG. 7, the ordinate represents the distance r from the data center O in the x-y coordinate system and the abscissa represents an angle about the data center O.

The converted pattern data transformed into the r-θ coordinate system by the pattern data converting means 50 in this manner are input to the pattern data comparing means 52. On the other hand, a denomination signal produced by the denomination determining means 35 is input to the reference pattern data storing means 51. In response, the reference pattern data storing means 51 selects the reference pattern data of the denomination corresponding to the denomination signal from among the reference pattern data of coins mapped in the r-θ coordinate system and stored therein and outputs it to the pattern data comparing means 52.

Figure 8:
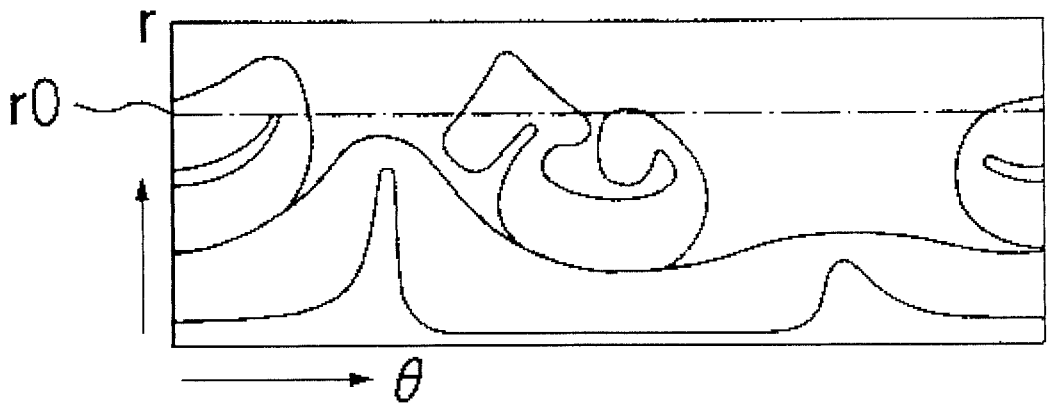
FIG. 8 is an example of a reference pattern data of the coin 1 mapped in the r-θ coordinate system shown in FIG. 6.

FIG. 8 shows an example of the reference pattern data of the coin 1 mapped in the r-θ coordinate system shown in FIG. 6. This data corresponds to the converted pattern data shown in FIG. 7. Since the converted pattern data shown in FIG. 7 are obtained by the pattern data converting means 50 by transforming the pattern data in the x-y coordinate system into the r-θ coordinate system based on the center coordinates (xc, yc) of the pattern data of the coin 1 calculated by the center coordinate determining means 36, the zero point of the ordinate, i.e., the zero point of the r-axis, coincides with the zero point of the reference pattern data shown in FIG. 8. However, since the orientation of the coin 1 to be discriminated is usually offset angularly (rotationally) from that of the coin 1 used for producing the reference pattern data, the pattern data at the same values in FIGS. 7 and 8 are normally obtained from different portions of the coin 1. Accordingly, it is impossible to discriminate the denomination of the coin 1, the genuineness of the coin 1 and the like by directly comparing the converted pattern data in FIG. 7 with the reference pattern data in FIG. 8. Therefore, it is necessary to correct the converted pattern data prior to the comparison so that the zero point of the converted pattern data in the θ axis coincides with the zero point of the reference pattern data in the θ axis.

In view of the above, the pattern data comparing means 52 reads the pattern data values at a predetermined distance r0 from the data center of the converted pattern data shown in FIG. 7, namely, reads the pattern data values whose ordinate values are equal to a predetermined value r0 over 360 degrees, reads the pattern data values at a predetermined distance r0 from the data center of the reference pattern data shown in FIG. 8, namely, reads the pattern data values whose ordinate values are equal to a predetermined value r0 over 360 degrees.

Then, the pattern data comparing means 52 compares both sets of pattern data values, thereby correcting the deviation of the converted pattern data in the axis caused by the angular offset of the coin 1.

Figure 9:
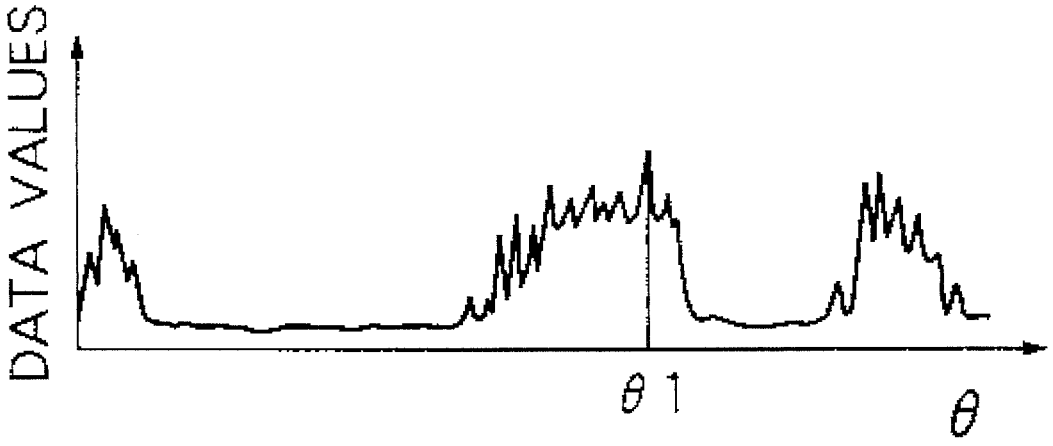
FIG. 9 is a graph showing a pattern data values obtained by reading the converted pattern data shown in FIG. 7.
Figure 10:
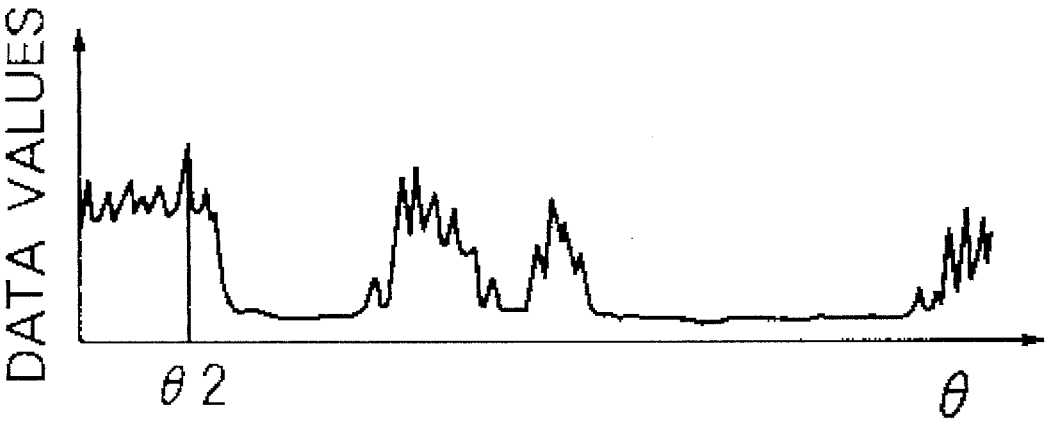
FIG. 10 is a graph showing a pattern data values obtained by reading the reference pattern data shown in FIG. 8.

FIG. 9 is a graph showing the pattern data values obtained by reading the converted pattern data shown in FIG. 7 over 360 degrees at a predetermined distance r0 from the data center and FIG. 10 is a graph showing the pattern data values obtained by reading the reference pattern data shown in FIG. 8 over 360 degrees at a predetermined distance r0 from the data center. In FIGS. 9 and 10, the ordinate represents data values and the abscissa represents the angle θ.

Coins 1 are fed through the coin passage 3 guided by the pair of guide rails 4, 5 and, therefore, the center of the coin 1 passes along a predetermined locus on the transparent passage portion 6. On the contrary, the location of the coin 1 is usually offset angularly with respect to the position of the coin 1 at the time of producing the reference pattern data. Therefore, since the sets of pattern data at the same value in FIGS. 7 and 8 are normally obtained from different portions of the coin 1, it is necessary to correct the converted pattern data prior to the comparison so that the zero point of the converted pattern data in the θ axis coincides with the zero point of the reference pattern data in the θ axis.

Figure 11:
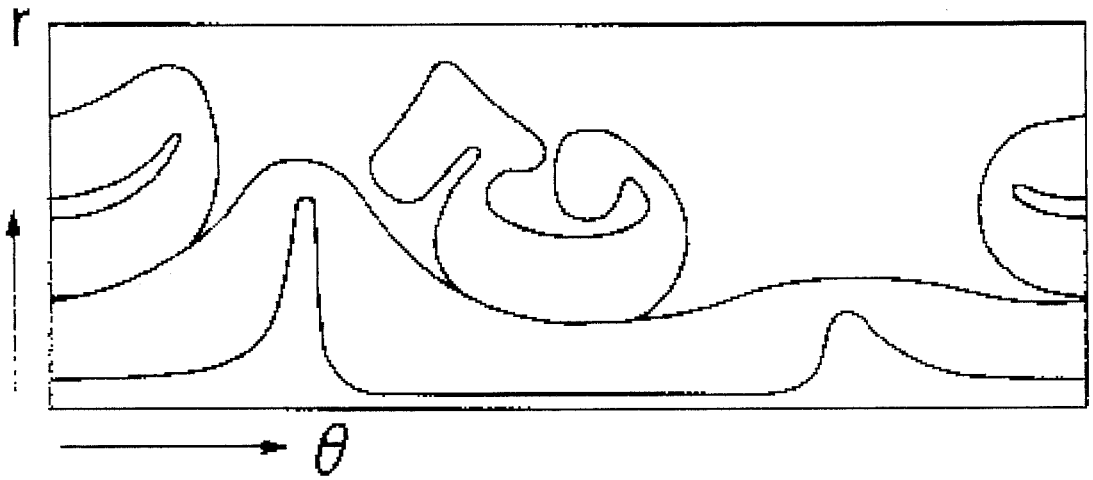
FIG. 11 shows the remapped converted pattern data.

Accordingly, the patten data comparing means 52 obtains θ values θ1 and θ2 at which the converted pattern data value shown in FIG. 9 and the pattern data value shown in FIG. 9 are maximum respectively and remaps the converted pattern data shown in FIG. 7 so that θ1 becomes equal to θ2. FIG. 11 shows such remapped converted pattern data.

The pattern data comparing means 52 compares the converted pattern data remapped in the above described manner and shown in FIG. 11 with the reference pattern data shown in FIG. 10 and the denomination determining means 35 determines the denomination of the coin 1, the genuineness of the coin 1 and whether or not the coin 1 is a foreign coin, in accordance with the extent of how well the converted pattern data coincides with the reference pattern data.

The constituted coin discriminating apparatus which is an embodiment of the present invention discriminates coins in the following manner.

The coin 1 is pressed onto the surface of the coin passage 3 by the endless belt 2 while it is advancing through the coin passage 3 along the pair of guide rails 4, 5 in the direction indicated by the arrow A. Its magnetic properties are detected by the pair of magnetic sensors 7, 7 and the detecting signal is output to the first determining means 31.

When the detected signal is input from the magnetic sensors 7, 7, the first determining means 31 accesses to the first reference data memory 30, reads the magnetic data showing the magnetic properties for each denomination stored in the first reference data memory 30, compares the magnetic data with the magnetic data of the coin 1 input from the magnetic sensors 7, 7, determines the denomination of the coin 1 and outputs the first determining signal to the denomination determining means 35 and the image reading control means 26.

When the coin 1 is fed into the transparent passage portion 6 within the coin passage 3, it blocks off the light emitted from the light emitting element 18 of the timing sensor 20, and the light receiving element 19 does not receive the light from the light emitting element 8. The timing signal from the timing sensor 20 is output to the light emitting control means 25 and the image reading control means 26.

When the timing signal from the timing sensor 20 is input to the light emitting control means 25, the light emitting control means 25 outputs the light emitting signal to the light emitting means 18 and causes the light emitting element 10 to emit light toward the lower surface of the coin 1 located on the transparent passage portion 6.

If it is determined that the coin 1 is the denomination of the coin made of a material having a high light reflectivity such as nickel, aluminum or the like in accordance with the first determining signal input from the first determining means 31, when the timing signal from the timing sensor 20 is input to the image reading control means 26, the image reading control means 26 outputs read a starting signal to the CCD 16 after a predetermined period of time, thereby causing it to start reading the reflected light of the coin 1. On the other hand, if it is determined that the coin 1 is the denomination of the coin made of a material having a low light reflectivity, such as copper, brass or the like, the image reading control means 26 immediately outputs the read starting signal to the CCD 16 and causes it to start reading the reflected light from the coin 1. The reason for controlling when the CCD 16 starts reading the reflected light based on the determined result of the denomination of the coin 1 by the first determining means 31 is because the amount of reflected light is different depending on the material of the coin 1 and the image pattern of the coin 1 cannot be detected accurately if the coin 1 is always illuminated with the same amount of light. Namely, when the coin is made of a material having high light reflectivity such as nickel, aluminum or the like, the total amount of detected light turns out to be too large and saturated if it receives the light for a long time. Therefore, the binary data corresponding to the surface pattern of the coin 1 can not be accurately produced by detecting the reflected light from the surface of the coin 1. On the other hand, when the coin is made of a material having low light reflectivity such as copper, brass or the like, the total amount of detected light turns out to be too little if it receive the light for a short period of time. Therefore, the binary data corresponding to the surface pattern of the coin 1 can not be accurately produced by detecting the reflected light from the surface of the coin 1. Thus, when the denomination of the coin 1 determined by the first determining means 31 is made of a material having high light reflectivity such as nickel, aluminum or the like, the image reading control means 26 controls such that the CCD 16 detects the reflected light from the coin 1 for a shorter period of time. On the other hand, when the denomination of the coin 1 determined by the first determining means 31 is made of a material having a low light reflectivity such as copper, brass or the like, the image reading control means 26 controls such that the CCD 16 detects the reflected light from the coin 1 for longer period of time, and allows the CCD 16 to receive enough reflected light.

The image pattern data of the coin 1 produced by the CCD 16 and converted into digital signals by the A/D converter 17 are mapped and stored into the x-y coordinate system in the image pattern data memory 32. FIG. 6 shows an example of the image pattern data of the coin 1 mapped and stored in the image pattern data memory 32.

When the image pattern data of the coin 1 are stored in the image pattern data memory 32, the second determining means 34 accesses the second reference data memory 33, reads the data with regard to the diameter of the coin 1, and reads the image pattern data stored in the image pattern data memory 32. The second determining means 34 compares the data with regard to the diameter of the coin with the image pattern data, determines the denomination of the coin 1 and outputs the second determining signal to the denomination determining means 35.

The denomination determining means 35 determines the denomination of the coin 1 in the same manner as the previous embodiment based on the first determining signal input from the first determining means 31 and second determining signal input from the first determining means 31, produces the denomination signal and outputs the denomination signal to the reference pattern data memory means 51.

On the other hand, the center coordinate determining means 36 determines the center coordinates (xc, yc) of the pattern data of the coin 1 based on the pattern data of the coin 1 mapped in the x-y coordinate system and stored in the mapped pattern data memory 32 and outputs it to the pattern data converting means 50.

Based on the center coordinates (xc, yc) of the pattern data of the coin 1 input from the center coordinate determining means 36, the pattern data converting means 50 transforms the pattern data of the coin 1 mapped in the x-y coordinate system and stored in the mapped pattern data memory 32 into an r-θ coordinate system. FIG. 7 shows an example of the converted pattern data transformed into the r-θ coordinate system.

Based on the denomination signal input from the denomination determining means 35, the reference pattern data storing means 51 selects the reference pattern data of the reverse face of the corresponding denomination from among the reference pattern data of the coin 1 mapped into the r-θ coordinate system and stored therein and outputs it to the pattern data comparing means 52. FIG. 8 shows an example of the reference pattern data output from the reference pattern data storing means 51 to the pattern data comparing means 52.

Since the pattern data cannot be produced by the CCD 16 with the coin 1 in a predetermined angular orientation and the coin 1 is normally offset angularly from the coin 1 used for producing the reference pattern data, as is clear from FIGS. 7 and 8, the converted pattern data is normally offset along the abscissa, namely, the θ axis, with respect to the reference pattern data. Therefore, it is necessary to correct the deviation of the converted pattern data in the θ direction caused by the offset of the coin 1 in the rotational direction and determine the coin 1 by comparing the converted pattern data with the reference pattern data.

Accordingly, the pattern data comparing means 52 reads the pattern data values of the converted pattern data shown in FIG. 7 over 360 degrees whose ordinate values are equal to a predetermined value r0 and reads the pattern data values of the reference pattern data shown in FIG. 8 over 360 degrees whose ordinate values are equal to a predetermined value r0.

FIGS. 9 and 10 are graphs obtained by plotting such read converted pattern data values and reference pattern data values whose ordinate values are equal to a predetermined value r0. The pattern data comparing means 52 further calculates θ values at which the converted pattern data values and the reference pattern data values become maximum respectively. The thus obtained θ values are θ1 in FIG. 9 and θ2 in FIG. 10.

When θ1 and θ2 are obtained in this manner, the pattern data comparing means 52 remaps the converted pattern data so that θ1 becomes equal to θ2. FIG. 11 shows an example of the converted pattern data thus remapped by the pattern data comparing means 52. Since the deviation of the converted pattern data in the θ direction caused by the angular offset of the coin 1 has been corrected by remapping the converted pattern data, it is possible for the pattern data comparing means 52 to determine whether the denomination of the coin 1 coincides with the denomination determined by the denomination determining means 35, a counterfeit coin or a foreign coin.

However, it is not possible to feed the coin 1 so that the same face always faces upward. When the coin 1 is carried so that the reverse face is facing upward, the remapped and converted patten data does not coincide with the reference pattern data of the reverse face of the selected denomination. Therefore, if it is determined that the coin is a counterfeit coin or a foreign coin since the remapped and converted pattern data does not coincide with the reference pattern data of the reverse face of the selected denomination in accordance with the denomination signal input from the denomination determining means 35, the accuracy of determining the coin is lowered.

Accordingly, in this embodiment, the converted pattern data are first compared with the reference pattern data of the reverse face of the coin 1 of the denomination tentatively determined by the denomination determining means 35. If they do not coincide, the converted pattern data are compared with the reference pattern data of the obverse face of the coin 1 of the denomination in the same manner, thereby determining whether the denomination of the coin 1 coincides with that tentatively determined by the denomination determining means 35, the genuineness of the coin 1 and whether or not the coin is a foreign coin.

In accordance with this embodiment, the first determining means 31 determines the denomination of the coin 1 based on the magnetic properties of the coin 1 detected by the magnetic sensors 7, 7, the second determining means 34 determines the denomination of the coin 1 based on the diameter of the coin 1, the denomination determining means 35 determines the denomination of the coin 1 based on both determined results, the data comparing means 39 compares the pattern data of the coin 1 only with the reference data of the denomination determined by the denomination determining means 35, whereby the denomination of the coin 1 and whether or not the coin 1 is acceptable are determined. Therefore, it is possible to shorten the time consumed for the determination in comparison to the case where it is compared with the reference data of all denominations. Furthermore, in the previously described embodiment, since the denomination of the coin 1 and whether or not the coin 1 is acceptable are determined based on the ratio of the "0" data in the binary pattern data groups corresponding to each annular area of the coin 1. Therefore, there is a possibility that the ratio data which are the ratio of the "0" data in the binary pattern data groups corresponding to each annular area of the coin 1 may happen to coincide with the reference ratio data of the coin of the denomination determined by the denomination determining means 35 even though the coin is a counterfeit coin and therefore, it is not acceptable. In this embodiment, however, the coin discriminating apparatus detects the pattern of the entire surface of the coin 1, produces the pattern data, and compares the pattern data with the reference pattern data of the denomination determined by the denomination determining means 35, thereby discriminating the coin 1. Therefore, the accuracy of the discrimination of the coin 1 can be improved. Moreover, since the deviation of the converted pattern data in the θ direction caused by the angular offset of a coin 1 can be corrected merely by obtaining the values θ1 and θ2 at which the respective data values of the converted pattern data and the reference pattern data whose ordinate values are equal to r0 become maximum and remapping the converted pattern data so that θ1 becomes equal to θ2, it is possible to shorten the time consumed for calculation, whereby coins 1 can be discriminated at high speed. Furthermore, it is controlled so that the CCD 16 receives the reflected light from the coin 1 for a longer period of time when the material of which the coin 1 is made has low light reflectivity, and the CCD 16 receives the reflected light from the coin 1 for a shorter period of time when the material of which the coin 1 is made has high light reflectivity. Therefore, regardless of the fact that the coin 1 is made of a material having high light reflectivity or low light reflectivity, it always produces the binary data corresponding to the surface pattern of the coin 1, whereby the denomination of the coin 1 and whether or not the coin 1 is acceptable can be accurately determined.

The present invention has thus been shown and described with reference to specific embodiments. However, it should be noted that the present invention is in no way limited to the details of the described arrangements but changes and modifications may be made without departing from the scope of the appended claims.

For example, in the embodiment shown in FIGS. 1 through 3, the intensity of light emitted from the light emitting element 10 is controlled by the light emitting control means 25 based on the determined result by the first determining means 31. In the embodiment shown in FIGS. 4 through 11, the image reading control means 26 controls the length of time the CCD 16 receives the light based on the determined result by the first discriminating means 31. However, in the embodiment shown in FIGS. 1 through 3, the length of time the CCD 16 receives the light can be controlled by the image reading control means 26, and in the embodiment in FIGS. 4 through 11, the intensity of the light emitted from the light emitting element 10 can be controlled by the light emitting control means 25. Furthermore, instead of controlling the intensity of the light emitted from the light emitting element 10, and thereby controlling the amount of emitted light, the amount of light emitted from the light emitting element 10 can also be controlled by controlling the length of time which the light emitting element 10 emits the light.

In the embodiment shown in FIGS. 1 thorough 3, when the data comparing means 39 compares the ratio data which is a ratio of the "0" data in the binary pattern data groups corresponding to each annular area of the coin 1 with the reference ratio data, and determines the denomination of coins, it determines whether or not the absolute values Di of the differences between the reference ratio data of each binary image pattern data group corresponding to each annular area of the coin 1 and the detected ratio data are less than the predetermined value $D_0$.

It also integrates the absolute values Di of the difference between the reference ratio data and the ratio data for all binary image pattern data groups corresponding to each annular area of the coin 1 and determines whether or not the resulted integrated value I is less than the predetermined value $I_0$, thereby determining whether or not the denomination of the coin 1 coincides with the denomination determined by the denomination determining means 35. However, the method for determining whether or not the denomination of the coin 1 coincides with the denomination determined by the denomination determining means 35 is not limited to the method described above and other methods can be employed.

In the embodiment shown in FIGS. 1 through 3, the ratio data are the ratio of the "0" data in the binary pattern data groups corresponding to each annular area of the coin 1 and the reference ratio data are the ratio of the "0" data in the binary image pattern data groups corresponding to the plurality of the annular areas of the coin surface of each denomination. However, instead of the ratio of the "0" data, they can be a ratio of "1" data.

In the embodiment shown in FIGS. 4 through 11, the deviation of the converted pattern data in the θ direction caused by the angular offset of a coin 1 is corrected only by obtaining the values θ1 and θ2 at which the respective data values of the converted pattern data and the reference pattern data whose ordinate values are equal to r0 become maximum and remapping the converted pattern data so that θ1 becomes equal to θ2. However, depending on the denomination of the coins, the data values of the reference pattern data whose ordinate values are equal to a predetermined value r0 may have the maximum value plus a plurality of values whose magnitudes are close to the maximum value. In such a case, the pattern data comparing means 52 may make erroneous judgment because a data value which is not maximum could be detected as the maximum value by mistake, in which case the deviation of the converted pattern data in the θ direction caused by the angular offset of the coin 1 could not be corrected even if the converted pattern data were remapped. As a result, the coin would not be accurately discriminated. For preventing such erroneous discrimination, converted pattern data can be remapped No times (No being an integer not smaller than 2) based on the data values in that order from greater data value to smaller data value.

Moreover, in the embodiment shown in FIGS. 4 through 11, instead of obtaining θ values θ1 and θ2 at which the data values of the converted pattern data and the reference pattern data whose ordinate values are equal to r0 become maximum, the square of the difference between the data values of the converted pattern data and the reference pattern data whose ordinate values are equal to a predetermined value r0 can be integrated over the range from 0 to 360 degrees of the θ value to obtain an integrated value and the graph of the data values of the converted pattern data shown in FIG. 9 be moved in parallel with the θ axis. When the calculated integrated value becomes minimum, it can be determined that the deviation of the converted pattern data caused by the angular offset of the coin 1 is corrected and the converted pattern data can be remapped to be compared with the reference data, thereby discriminating the coin 1. Moreover, the difference between the values of the converted pattern data and the reference pattern data whose ordinate values are equal to a predetermined value r0 can be integrated over the range from 0 to 360 degrees of the θ value to obtain an integrated value and the graph of the data values of the converted pattern data shown in FIG. 9 be moved in parallel with the θ axis. When the calculated integrated value becomes minimum, it can be judged that the deviation of the converted pattern data caused by the angular offset of the coin 1 is corrected and the converted pattern data can be remapped to be compared with the reference data, thereby discriminating the coin 1.

Furthermore, in the above described embodiment, although the CCD 16 is used as an area sensor for detecting the light reflected by the surface of the coin 1, other types of sensors such as a line sensor may be used instead.

Moreover, in the embodiment described above, the light emitting elements 10 emits the light in accordance with the timing signals from the timing sensors 20. However, the light emitting element can be composed such that it always emit the light.

In the embodiment shown in FIGS. 4 through 11, the converted pattern data is first compared with the reference pattern data of the reverse face of the coin 1 of the denomination tentatively determined by the denomination determining means 35. If they do no coincide, the converted pattern data may be compared with the reference pattern data of the obverse face of the coin 1 of the denomination in the same manner, thereby discriminating whether the denomination of the coin 1 coincides with that tentatively determined denomination by the denomination determining means 35, the genuineness of the coin 1 and whether or not the coin is a foreign coin. However, the converted pattern data can be first compared with the reference pattern data of the obverse face of the coin 1 of the denomination tentatively determined by the denomination determining means 35 and if they do not coincide, the converted pattern data can be compared with the reference pattern data of the reverse face of the coin 1 of the denomination in the same manner, thereby discriminating whether the denomination of the coin 1 coincides with that tentatively determined denomination by the denomination determining means 35, the genuineness of the coin 1 and whether or not the coin is a foreign coin.

Further, in this specification and the appended claims, the respective means need not necessarily be physical means and arrangements whereby the functions of the respective means are accomplished by software fall within the scope of the present invention.

In addition, the function of a single means may be accomplished by two or more physical means and the functions of two or more means may be accomplished by a single physical means.

I claim:

1. A coin discriminating apparatus, comprising:

illuminating means for emitting light and illuminating a surface of a coin, light receiving means for receiving reflected light from the surface of said coin and producing pattern data of said coin, pattern data storing means for storing the pattern data of said coin produced by said light receiving means, reference data storing means for storing reference pattern data of each denomination, sensor means for detecting a material of the coin, first determining means for determining a denomination of the coin based on the material of the coin detected by said sensor means, second determining means for determining a diameter of the coin based on said pattern data stored in said pattern data storing means and determining the denomination of the coin based on a diameter of the coin, denomination determining means for determining the denomination of the coin based on the determined results by said first and second determining means, data comparing means for reading the reference pattern data corresponding to the denomination of the coin stored in said reference data storing means based on the determined result by said denomination determining means and comparing them with the pattern data stored in said pattern data storing means, said pattern data storing means being constructed to map and store the pattern data of said coin produced by said light receiving means in an x-y coordinate system;

center coordinate determining means for calculating center coordinates of the pattern data mapped in the x-y coordinate system in the pattern data storing means, and pattern data converting means for converting the pattern data mapped in the x-y coordinate system and stored in said pattern data storing means into the r-θ coordinate system based on center coordinates in the x-y coordinate system of the pattern data calculated by said center coordinate determining means, thereby producing converted pattern data;

said reference data storing means being constructed to store the reference pattern data mapped in the r-θ coordinate system and said data comparing means being constructed to correct said converted pattern data along the θ-axis and to compare corrected converted pattern data with the reference pattern data corresponding to the denomination read from said reference data storing means based on the determined result by said denomination determining means, thereby determining the denomination of the coin.

2. The coin discriminating apparatus as recited in claim 1, further comprising light emitting control means for controlling said illuminating means, said light emitting control means being constructed to control the amount of light emitted from said illuminating means based on the determined result by said first determining means.

3. The coin discriminating apparatus as recited in claim 1, further comprising light receiving control means for controlling said light receiving means, and said light receiving control means is adapted to control the length of time for which said light receiving means receives the light based on the determined result by said first determining means.

4. The coin discriminating apparatus as recited in claim 1, wherein said reference pattern data of each denomination includes the reference pattern data of both faces of the coin.

5. The coin discriminating apparatus as recited in claim 1, further comprising light emitting control means for controlling said illuminating means, and said light emitting control means being constructed to control the amount of light emitted from said illuminating means based on the determined result by said first determining means.

6. The coin discriminating apparatus as recited in claim 4, further comprising light receiving control means for controlling said light receiving means, and said light receiving control means is adapted to control the length of time for which said light receiving means receives the light based on the determined result by said first determining means.

7. A coin discriminating apparatus, comprising:

illuminating means for emitting light and illuminating a surface of a coin, light receiving means for receiving reflected light from the surface of said coin and producing pattern data of said coin, pattern data storing means for storing the pattern data of said coin produced by said light receiving means, reference data storing means for storing reference pattern data of each denomination, sensor means for detecting a material of the coin, first determining means for determining a denomination of the coin based on the material of the coin detected by said sensor means, second determining means for determining a diameter of the coin based on said pattern data stored in said pattern data storing means and determining the denomination of the coin based on a diameter of the coin, denomination determining means for determining the denomination of the coin based on the determined results by said first and second determining means, data comparing means for reading the reference pattern data corresponding to the denomination of the coin stored in said reference data storing means based on the determined result by said denomination determining means and comparing them with the pattern data stored in said pattern data storing means, and light emitting control means for controlling said illuminating means, said light emitting control means being constructed to control the amount of light emitted from said illuminating means based on the determined result by said first determining means.

8. A coin discriminating apparatus, comprising:

illuminating means for emitting light and illuminating a surface of a coin, light receiving means for receiving reflected light from the surface of said coin and producing pattern data of said coin, pattern data storing means for storing the pattern data of said coin produced by said light receiving means, reference data storing means for storing reference pattern data of each denomination, sensor means for detecting a material of the coin, first determining means for determining a denomination of the coin based on the material of the coin detected by said sensor means, second determining means for determining a diameter of the coin based on said pattern data stored in said pattern data storing means and determining the denomination of the coin based on a diameter of the coin, denomination determining means for determining the denomination of the coin based on the determined results by said first and second determining means, data comparing means for reading the reference pattern data corresponding to the denomination of the coin stored in said reference data storing means based on the determined result by said denomination determining means and comparing them with the pattern data stored in said pattern data storing means, said reference pattern data of each denomination including the reference pattern data of both faces of the coin, and light emitting control means for controlling said illuminating means, said light emitting control means being constructed to control the amount of light emitted from said illuminating means based on the determined result by said first determining means.

9. A coin discriminating apparatus, comprising:

illuminating means for emitting light and illuminating a surface of a coin, light receiving means for receiving reflected light from the surface of said coin and producing pattern data of said coin, pattern data storing means for storing the pattern data of said coin produced by said light receiving means, reference data storing means for storing reference pattern data of each denomination, sensor means for detecting a material of the coin, first determining means for determining a denomination of the coin based on the material of the coin detected by said sensor means, second determining means for determining a diameter of the coin based on said pattern data stored in said pattern data storing means and determining the denomination of the coin based on a diameter of the coin, denomination determining means for determining the denomination of the coin based on the determined results by said first and second determining means, data comparing means for reading the reference pattern data corresponding to the denomination of the coin stored in said reference data storing means based on the determined result by said denomination determining means and comparing them with the pattern data stored in said pattern data storing means, and light receiving control means for controlling said light receiving means, said light receiving control means being constructed to control the length of time for which said light receiving means receives the light based on the determined result by said first determining means.

10. A coin discriminating apparatus, comprising:

illuminating means for emitting light and illuminating a surface of a coin, light receiving means for receiving reflected light from the surface of said coin and producing pattern data of said coin, pattern data storing means for storing the pattern data of said coin produced by said light receiving means, reference data storing means for storing reference pattern data of each denomination, sensor means for detecting a material of the coin, first determining means for determining a denomination of the coin based on the material of the coin detected by said sensor means, second determining means for determining a diameter of the coin based on said pattern data stored in said pattern data storing means and determining the denomination of the coin based on a diameter of the coin, denomination determining means for determining the denomination of the coin based on the determined results by said first and second determining means, data comparing means for reading the reference pattern data corresponding to the denomination of the coin stored in said reference data storing means based on the determined result by said denomination determining means and comparing them with the pattern data stored in said pattern data storing means, said reference pattern data of each denomination including the reference pattern data of both faces of the coin, and light receiving control means for controlling said light receiving means, said light receiving control means being constructed to control the length of time for which said light receiving means receives the light based on the determined result by said first determining means.

* * * * *